US006497558B1

(12) United States Patent
Hale

(10) Patent No.: US 6,497,558 B1
(45) Date of Patent: Dec. 24, 2002

(54) HYDRAULIC PRESSURE TRANSFORMER

(75) Inventor: David C. Hale, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/516,566

(22) Filed: Mar. 1, 2000

(51) Int. Cl.[7] ..... F04B 49/00
(52) U.S. Cl. ..... 417/220; 417/405; 418/31
(58) Field of Search ..... 417/220, 405; 418/30, 31; 60/452

(56) References Cited

U.S. PATENT DOCUMENTS

| | | | | |
|---|---|---|---|---|
| 3,740,954 A | | 6/1973 | Young | |
| 3,808,814 A | | 5/1974 | Macy, II | |
| 4,510,750 A | * | 4/1985 | Izumi et al. | 60/443 |
| 4,851,723 A | * | 7/1989 | Barnhardt | 418/31 |
| 5,129,230 A | * | 7/1992 | Izumi et al. | 60/452 |
| 5,595,067 A | * | 1/1997 | Maness | 418/31 |

FOREIGN PATENT DOCUMENTS

| | | |
|---|---|---|
| DE | 29 28 169 | 4/1988 |
| WO | WO 88/02438 | 1/1981 |

* cited by examiner

*Primary Examiner*—Charles G. Freay
(74) *Attorney, Agent, or Firm*—Taylor & Aust P C

(57) ABSTRACT

A hydraulic pressure transformer for the conversion of an input hydraulic power to an output hydraulic power has a cam block. The cam block has a cam opening defining a pump section and a motor section. The pump section includes at least one pump inlet port and at least one pump outlet port. The motor section includes at least one motor inlet port and at least one motor outlet port. A rotor is disposed within the cam opening and is rotatable about an axis of rotation. The rotor includes a peripheral surface, a plurality of radially extending slots opening at the peripheral surface and a plurality of vanes respectively disposed in the slots. The rotor and/or cam block are movable relative to each other in at least one direction generally perpendicular to the axis of rotation.

17 Claims, 2 Drawing Sheets

HYDRAULIC PRESSURE TRANSFORMER

TECHNICAL FIELD

The present invention relates to hydraulic pressure transformers, and, more particularly, to hydraulic pressure transformers having a rotor within an opening.

BACKGROUND ART

Hydraulic pressure transformers are used to transform an input flow of hydraulic fluid at a first flow rate and pressure to an output flow of hydraulic fluid at a second flow rate and pressure. The output flow rate and pressure are variable to provide a variable output flow and/or a variable output pressure for use with a specific application, such as a hydrostatic transmission.

Conventional hydraulic pressure transformers may have a housing with a rotatable barrel and a movable port plate disposed therein. The port plate has three arcuate slots which selectively interconnect a plurality of ports in the housing with a plurality of cylinders in the barrel upon rotation of the barrel during use. The relative position between the slots in the port plate and the ports in the housing define the output pressure from the hydraulic pressure transformer.

Examples of hydraulic pressure transformers as described above are disclosed in U.S. Pat. No. 5,878,649 (Raab), issued Mar. 9, 1999 and assigned to the assignee of the present invention; and PCT Document No. PCT/NL97/00084 (Achten), published Aug. 28, 1997.

It is also known to provide a hydraulic pressure transformer with a port block instead of a port plate between the housing and barrel. The port block has a spherical surface on each end thereof which abuts a complimentary spherical surface on the housing and barrel, respectively. The spherical surfaces at each end of the port block allow slight tipping or tilting between the housing, port block and barrel, while at the same time maintaining a substantially sealed relationship therebetween.

Although effective during use, hydraulic pressure transformers having a rotatable barrel and a plurality of axially extending cylinders as described above tend to be relatively complex and expensive to manufacture.

The present invention is directed to overcoming one or more of the problems as set forth above.

DISCLOSURE OF THE INVENTION

In one aspect of the invention, a hydraulic pressure transformer for the conversion of an input hydraulic power to an output hydraulic power comprises a cam block including a cam opening defining a pump section and a motor section. The pump section includes at least one pump inlet port and at least one pump outlet port. The motor section includes at least one motor inlet port and at least one motor outlet port. A rotor is disposed within the cam opening and is rotatable about an axis of rotation. The rotor includes a peripheral surface, a plurality of radially extending slots opening at the peripheral surface and a plurality of vanes respectively disposed in the slots. The rotor and/or cam block are movable relative to each other in at least one direction generally perpendicular to the axis of rotation.

In another aspect of the invention, a work machine comprises a frame; a hydraulic work unit; and a hydraulic pressure transformer for the conversion of an input hydraulic power to an output hydraulic power. The hydraulic pressure transformer includes a housing carried by the frame, and a cam block slidably disposed within the housing. The cam block includes a cam opening defining a pump section and a motor section. The pump section includes at least one pump inlet port and at least one pump outlet port. The motor section includes at least one motor inlet port and at least one motor outlet port. A rotor is disposed within the cam opening and is rotatable about an axis of rotation. The rotor includes a peripheral surface, a plurality of radially extending slots opening at the peripheral surface and a plurality of vanes respectively disposed in the slots. The rotor and/or cam block are movable relative to each other in at least one direction generally perpendicular to the axis of rotation.

In yet another aspect of the invention, a method of operating a hydraulic pressure transformer to convert an input hydraulic power to an output hydraulic power comprises the steps of: providing a cam block including a cam opening defining a pump section and a motor section, the pump section including at least one pump inlet port and at least one pump outlet port, the motor section including at least one motor inlet port and at least one motor outlet port; positioning a rotor within the cam opening, the rotor being rotatable about an axis of rotation, the rotor including a peripheral surface, a plurality of radially extending slots opening at the peripheral surface and a plurality of vanes respectively disposed in the slots; providing a hydraulic fluid supply tank fluidly connected with the pump inlet port, pump outlet port, motor inlet port and motor outlet port; rotating the rotor within the cam opening such that hydraulic fluid flows through each of the pump section and motor section; and moving the rotor and/or cam block relative to each other in at least one direction generally perpendicular to the axis of rotation.

BEST MODE FOR CARRYING OUT THE INVENTION

Figure 1:
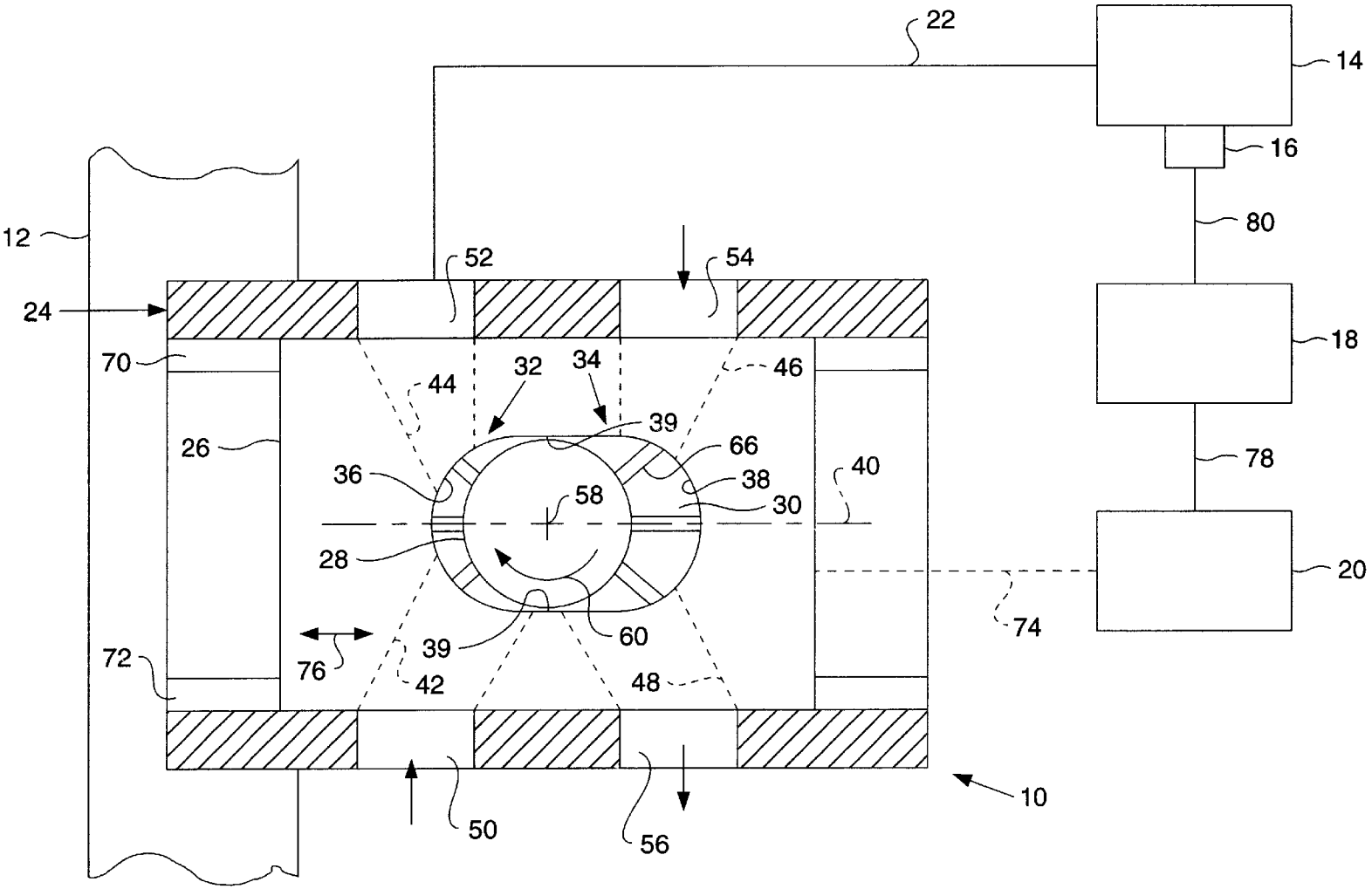
FIG. 1 is a side, sectional view of an embodiment of a hydraulic pressure transformer of the present invention mounted to a work machine, with an attached hydraulic work unit and input control system shown in partial schematic form.

Referring now to the drawings, there is shown an embodiment of a hydraulic pressure transformer 10 of the present invention which is used to convert an input hydraulic power to an output hydraulic power, as will be described in more detail hereinafter. Hydraulic pressure transformer 10 may be used in conjunction with a work machine 12 and provides a high pressure hydraulic output power to a hydraulic work unit 14. An input control system has a sensor 16, controller 18 and an electric or, a hydraulic or a mechanical drive 20 control operation of hydraulic pressure transformer 10, as will be described in more detail hereinafter.

Hydraulic work unit 14 may be of any type of apparatus which requires hydraulic input power which may be supplied by hydraulic pressure transformer 10. For example, when hydraulic work unit 14 is coupled with the hydraulic ports of hydraulic pressure transformer 10 as shown in FIG. 1, a high pressure, low flow hydraulic input is provided to hydraulic work unit 14. Hydraulic work unit 14 may thus be in the form of a hydrostatic transmission requiring a high pressure and low flow hydraulic power input, as designated by line 22. Other types of hydraulic work units are also possible.

Work machine 12 may be any suitable work machine utilizing a hydraulic work unit 14 and hydraulic pressure transformer 10. For example, work machine 12 may be in the form of a skid loader, utility tractor, motor vehicle,. etc. In FIG. 1, only a portion of the frame of work machine 12 is illustrated for ease of description. Hydraulic pressure transformer 10 is coupled with and carried by the frame of work machine 12 in a suitable manner, such as with bolts, welding or any other suitable attachment technique.

Hydraulic pressure transformer 10 generally has a housing 24, a cam block 26 and a rotor 28. Cam block 26 includes a cam opening 30 defining a pump section 32 and a motor section 34. More particularly, cam block 26 has a pair of cam surfaces 36 and 38 connected by a pair of transition surfaces 39 which respectively define pump section 32 and motor section 34. In the embodiment shown, the pair of cam surfaces 36 and 38 are each generally symmetrically contoured on either side of a plane of symmetry 40. And, the pair of transition surfaces 39 extend generally parallel to the plane of symmetry 40. However, dependent upon the specific application, the pair of cam surfaces 36 and 38, and the pair of transition surfaces 39 need not necessarily be symmetrically positioned on either side or parallel with the plane of symmetry 40.

Cam block 26 also includes a plurality of fluid ports associated with pump section 32 and motor section 34. Specifically, in the embodiment shown, cam block 26 has a single pump inlet port 42 and a single pump outlet port 44 associated with pump section 32; and a single motor inlet port 46 and a single motor outlet port 48 associated with motor section 34. Pump inlet port 42 and pump outlet port 44 each extend to and are in fluid communication with cam surface 36 of pump section 32. Pump inlet port 42 receives hydraulic fluid from a hydraulic fluid supply tank 90 carried by work machine 12. Pump outlet port 44 provides hydraulic fluid at high pressure and low flow conditions to hydraulic work unit 14 via channel 52 and line 22. Similarly, motor inlet port 46 and motor outlet port 48 each extend to and are in communication with cam surface 38 of motor section 34. Motor inlet port 46 receives pressurized hydraulic fluid via channel 54 from a source of pressurized hydraulic fluid, such as a free piston internal combustion engine or a separate hydraulic supply such as a pump (not shown). Motor outlet port 48 discharges hydraulic fluid via channel 56 to the hydraulic fluid supply tank.

In the embodiment shown in FIG. 1, pump inlet port 42, pump outlet port 44, motor inlet port 46 and motor outlet port 48 are each configured to terminate adjacent to channels 50, 52, 54 and 56, respectively. However, pump inlet port 42, pump outlet port 44, motor inlet port 46 and motor outlet port 48 may extend to and terminate at any suitable peripheral location of cam block 22 allowing proper fluid interconnection with hydraulic pressure transformer 10. For example, it may be possible for pump inlet port 42, pump outlet pump 44, motor inlet port 46 and motor outlet port 48 to extend to and terminate at a location at the longitudinal ends of cam block 26. Of course, configured in this manner, fluid interconnection with hydraulic pressure transformer 10 may require flexible fluid couplings, etc. for proper fluid interconnection with cam block 26.

Additionally, in the embodiment shown in FIG. 1, a single inlet port and outlet port are provided in communication with pump section 32; and a single inlet port and outlet port are provided in communication with motor section 34. However, it is also possible to provide multiple inlet ports and/or outlet ports in communication with pump section 32 and/or motor section 34. Additionally, the size of pump inlet port 42, pump outlet port 44, motor inlet port 46 and motor outlet port 48 may vary, dependent upon the specific application.

Figure 2:
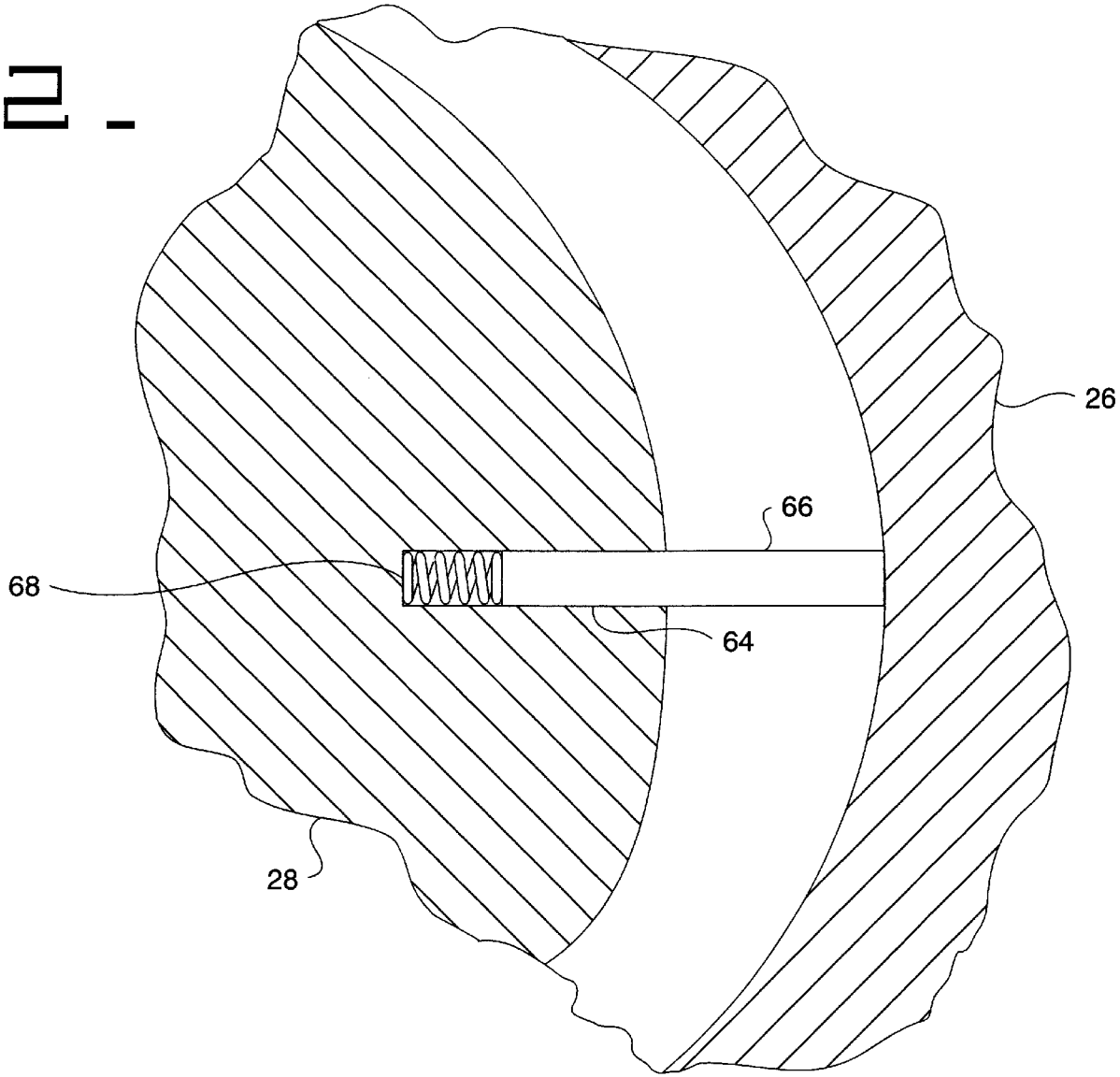
FIG. 2 is an enlarged, sectional view of a portion of the hydraulic pressure transformer of FIG. 1, illustrating one of a plurality of vanes carried by a rotor and engaged with a cam block.

Rotor 28 is disposed within cam opening 30, and is rotatable about an axis of rotation 58, as indicated by directional arrow 60. Rotor 28 includes a peripheral surface 62 and a plurality of slots 64 which open at peripheral surface 62 and extend radially inward therefrom toward axis of rotation 58. A plurality of vanes 66 (FIGS. 1 and 2) are respectively disposed in slots 64. Vanes 66 are biased in a radially outward direction using a plurality of springs 68 which are disposed within respective slots 64. In the embodiment shown, a single spring 68 is disposed within each slot 64; however, it may also be necessary or desirable to provide a plurality of springs within each slot 64. Additionally, each spring 68 is configured as a compression spring in the embodiment shown. However, other types of biasing devices such as an elastomeric or a hydraulic biasing device, etc. may also be utilized.

Cam block 26 is movable relative to rotor 28 to adjust the relative position of rotor 28 within each of pump section 32 and motor section 34. More particularly, cam block 26 is slidably disposed within a first channel 70 and second channel 72 formed within housing 24. Cam block 26 is coupled with mechanical drive 20, as indicated schematically by dashed line 74, to slidably move cam block 26 within channels 70 and 72 of housing 24, as indicated by double headed directional arrow 76. Mechanical drive 20 is electrically connected with controller 18 via line 78 to selectively adjust the position of cam block 26 within housing 24. Controller 18 receives a signal from sensor 16 via line 80 indicative of an operating characteristic of hydraulic work unit 14. For example, sensor 16 may transmit a signal via line 80 to controller 18 representing the load or output speed of hydraulic work unit 14. Controller 18 controls mechanical drive 20, dependent upon the value of the control signal received from sensor 16.

INDUSTRIAL APPLICABILITY

During use, rotor 28 which is "free wheeling" is rotated in a clockwise direction 60 by the incoming hydraulic fluid within cam opening 30 of cam block 26. Rotor 28 is disposed at least partly within each of pump section 32 and motor section 34 within cam opening 30. The individual springs 68 maintains each of the plurality of vanes 66 in contact with the cam surfaces 36, 38 or 39 of the cam opening 30. As rotor 28 rotates at an operating speed, centrifugal force assists in biasing the plurality of vanes 66 radially outward against an adjacent cam surface 36, 38 or 39. Pressurized hydraulic fluid enters motor section 34 through motor inlet port 46 and exerts a rotational force against vanes 66 causing rotation of rotor 28 in clockwise direction 60. The hydraulic fluid discharges through motor outlet port 48 and returns to the hydraulic fluid supply tank. Additionally, it may also be possible to transport at least part of the fluid exiting through motor outlet port 48 to the inlet side of pump inlet port 42 assisting the flow of hydraulic fluid into inlet port 42 of the pump section 32.

Pump inlet port 42 receives hydraulic fluid from the hydraulic fluid supply tank and/or motor outlet port 48 at a first pressure. As rotor 28 continues to rotate, the resistance of the work causes the pressure to rise to a predetermined level resulting in the pressure of the hydraulic fluid therein being increased. Thus, the hydraulic fluid is discharged at a higher pressure through pump outlet port 44. The high pressure hydraulic fluid then flows through channel 52 and line 22 to hydraulic work unit 14 to provide input hydraulic power thereto. In this application, operating characteristics such as load, output speed, etc. are sensed by sensor 16, which in turn transmits a signal via line 80 to controller 18 for feedback control of the position of cam block 26 within housing 24. However, as an alternative, a fixed ration device could also be employed.

Hydraulic pressure transformer 10 of the present invention provides a simple and effective apparatus for converting hydraulic input power at a first pressure and flow rate to a hydraulic output power at a higher pressure and lower flow rate. Additionally, if reversed, the transformer 10 could be used to provide a lower pressure and a higher flow rate. By providing a rotor with radially extending slots and vanes disposed therein, discrete pressure chambers can be easily and inexpensively formed within cam opening 30 of cam block 26. Additionally, sliding cam block 26 within housing 24 provides easy, accurate and inexpensive positioning and control of the output pressure and flow rate from hydraulic pressure transformer 10.

Other aspects, objects and advantages of this invention can be obtained from a study of the drawings, the disclosure and the appended claims.

What is claimed is:

1. A hydraulic pressure transformer for the conversion of an input hydraulic power to an output hydraulic power, said hydraulic pressure transformer comprising:

a cam block including a cam opening defining a pump section and a motor section, said pump section including at least one pump inlet port and at least one pump outlet port, said motor section including at least one motor inlet port and at least one motor outlet port, said cam opening having a pair of cam surfaces connected by a pair of transition surfaces, said cam opening having a plane of symmetry associated therewith, said pair of transition surfaces being substantially parallel to s aid plane of symmetry; and a rotor disposed within said cam opening and rotatable about an axis of rotation, said rotor including a peripheral surface, a plurality of radially extending slots opening at said peripheral surface and a plurality of vanes respectively disposed in said slots, at least one of said rotor and said cam block being movable relative to an other of said rotor and said cam block in at least one direction generally perpendicular to said axis of rotation.

2. The hydraulic pressure transformer of claim 1, said cam block being movable relative to said rotor such that a relative position of said rotor in each of said pump section and said motor section is selectively adjusted.

3. The hydraulic pressure transformer of claim 2, including a housing, said cam block being slidably disposed within said housing.

4. The hydraulic pressure transformer of claim 3, including a mechanical drive coupled with said cam block for slidably moving said cam block within said housing, and a controller coupled with and controlling operation of said drive.

5. The hydraulic pressure transformer of claim 1, said cam block being movable relative to said rotor in opposite directions generally parallel to said plane of symmetry.

6. The hydraulic pressure transformer of claim 1, each of said plurality of vanes being biased in a radially outward direction.

7. The hydraulic pressure transformer of claim 6, including a plurality of springs respectively disposed in said slots, each said spring engaging and biasing a corresponding said vane in said radially outward direction.

8. The hydraulic pressure transformer of claim 1, wherein said at least one pump inlet port includes a single pump inlet port, said at least one pump outlet port including a single pump outlet port, said at least one motor inlet port including a single motor inlet port, and said at least one motor outlet port including a single motor outlet port.

9. A work machine, comprising:

a frame;

a hydraulic work unit; and a hydraulic pressure transformer for the conversion of an input hydraulic power to an output hydraulic power, said hydraulic pressure transformer including:

a housing carried by said frame;

a cam block located substantially within said housing and slidably disposed therewithin, said cam block including a cam opening defining a pump section and a motor section, said pump section including at least one pump inlet port and at least one pump outlet port, said motor section including at least one motor inlet port and at least one motor outlet port, one of said pump outlet port and said motor outlet port being coupled to said hydraulic work unit; and a rotor disposed within said cam opening and rotatable about an axis of rotation, said rotor including a peripheral surface, a plurality of radially extending slots opening at said peripheral surface and a plurality of vanes respectively disposed in said slots, at least one of said rotor and said cam block being movable relative to an other of said rotor and said cam block in at least one direction generally perpendicular to said axis of rotation.

10. The hydraulic pressure transformer of claim 9, said cam block being movable relative to said rotor such that a relative position of said rotor in each of said pump section and said motor section is selectively adjusted.

11. The hydraulic pressure transformer of claim 9, including a mechanical drive coupled with said cam block for slidably moving said cam block within said housing, and a controller coupled with and controlling operation of said drive.

12. The hydraulic pressure transformer of claim 9, said cam opening including adjoining cam surfaces defining a plane of symmetry, said cam block being movable relative to said rotor in opposite directions generally parallel to said plane of symmetry.

13. The hydraulic pressure transformer of claim 9, each of said plurality of vanes being biased in a radially outward direction.

14. The hydraulic pressure transformer of claim 13, including a plurality of springs respectively disposed in said slots, each said spring engaging and biasing a corresponding said vane in said radially outward direction.

15. The hydraulic pressure transformer of claim 9, including a hydraulic fluid supply tank fluidly connected with each of said pump inlet port, said pump outlet port, said motor inlet port and said motor outlet port.

16. A method of operating a hydraulic pressure transformer to convert an input hydraulic power to an output hydraulic power, said method comprising the steps of:

providing a cam block including a cam opening defining a pump section and a motor section, said pump section including at least one pump inlet port and at least one pump outlet port, said motor section including at least one motor inlet port and at least one motor outlet port, said cam opening having a pair of cam surfaces connected by a pair of transition surfaces, said cam openings having a plane of symmetry associated therewith, said pair of transition surfaces being substantially parallel to said plane of symmetry;

positioning a rotor within said cam opening, said rotor being rotatable about an axis of rotation, said rotor including a peripheral surface, a plurality of radially extending slots opening at said peripheral surface and a plurality of vanes respectively disposed in said slots;

providing a hydraulic fluid supply tank fluidly connected with each of said pump inlet port, said pump outlet port, said motor inlet port and said motor outlet port;

rotating said rotor within said cam opening such that hydraulic fluid flows through each of said pump section and said motor section; and moving at least one of said rotor and said cam block relative to an other of said rotor and said cam block in at least one direction generally perpendicular to said axis of rotation.

17. The method of claim 16, said moving step including moving said cam block in opposite directions generally parallel to said plane of symmetry.

* * * * *